United States Patent [19]

Orchard

[11] 4,265,393

[45] May 5, 1981

[54] BOX CONSTRUCTION

[75] Inventor: Edgar L. Orchard, St. Louis County, Mo.

[73] Assignee: Orco Sales Co. Inc., St. Louis, Mo.

[21] Appl. No.: 83,237

[22] Filed: Oct. 10, 1979

[51] Int. Cl.[3] ..... B65D 5/10

[52] U.S. Cl. ..... 229/40; 229/36

[58] Field of Search ..... 229/36, 33, 40

[56] References Cited

U.S. PATENT DOCUMENTS

| | | | |
|---|---|---|---|
| 1,182,585 | 5/1916 | Richardson | 229/36 X |
| 1,824,927 | 9/1931 | Powell | 229/33 X |
| 2,285,991 | 6/1942 | Lester | 229/40 X |
| 2,944,717 | 7/1960 | Lynch | 229/36 X |
| 3,114,492 | 12/1963 | Engström | 229/40 X |
| 3,357,544 | 12/1967 | Gingher | 229/40 X |
| 3,368,735 | 2/1968 | Levi | 229/40 |
| 3,627,541 | 12/1971 | Fanquhar | 229/40 X |
| 4,046,311 | 9/1977 | Voytko | 229/40 |

*Primary Examiner*—Davis T. Moorhead

*Attorney, Agent, or Firm*—Kalish & Gilster

[57] ABSTRACT

A box of cardboard, paperboard, fiberboard or the like assembled from a single, die cut blank comprising a bottom wall, side walls, front and back walls, and a swingable top closure. The side walls are provided with inturned flanges underlying a flange extending rearwardly from the front wall which latter contains outwardly projecting stops. The top wall carries locking tabs for restrictive abutting relationship with the proximate stop and which tabs embody tongues lockingly engageable in openings in said side wall; there being abutments for limiting lateral shifting of said top wall when the box is closed.

10 Claims, 5 Drawing Figures

BOX CONSTRUCTION

BACKGROUND AND SUMMARY OF THE INVENTION

This invention relates in general to containers and, more particularly, to a box construction as formed through appropriate folding from a die cut blank.

Heretofore, containers as formed of cardboard, paperboard and the like for the safe transport of particularly comestibles having a delicate character, such as, for instance, pizza, pies, cakes and the like, have been of two general types. One such type comprises cooperating open top boxes and independent closures therefor, thus requiring a two part construction, and necessitating close tolerance between such components to assure of a relatively snug fit for the closure. However, in actual usage, unless extreme care is exercised, the top closure may become displaced with undesired results for the retention of the contents in original state. The other generally utilized type of container is the well known bakery box having a foldable top closure with a tongue or extension at the forward end thereof, but these boxes are of relatively fragile character and necessitate the individual maintaining close care as to the handling of such box or container while carrying the same. Furthermore, these bakery containers have little or no reliability for inherent maintenance of closed condition and, therefore, have consistently necessitated resort to string, scotch tape, or other extrinsic securing means.

Therefore, it is an object of the present invention to provide a box which may be readily formed from a single die cut bland and which is peculiarly adapted for protected transport of pizza, cakes, pies and the like so as to retain same against crushing or like damage materially affecting the expected appealing appearance thereof.

It is another object of the present invention to provide a box of the character stated which integrally incorporates unique latching means so as to prevent accidental, premature opening of the box and thereby assure proper retention of the contents during transport.

It is a further object of the present invention to provide a box of the character stated which incorporates novel components for guarding delicate contents against any damage through downward, crushing movement of the top closure.

It is a still further object of the present invention to provide a box of the character stated which may be most economically manufactured; which does not require resort to any extrinsic elements or accessories for maintaining same in closed condition, or for construction of the same; which is so designed as to assure of structural integrity; and which is most reliable and durable in usage.

DESCRIPTION OF THE PREFERRED EMBODIMENT

Figure 1:
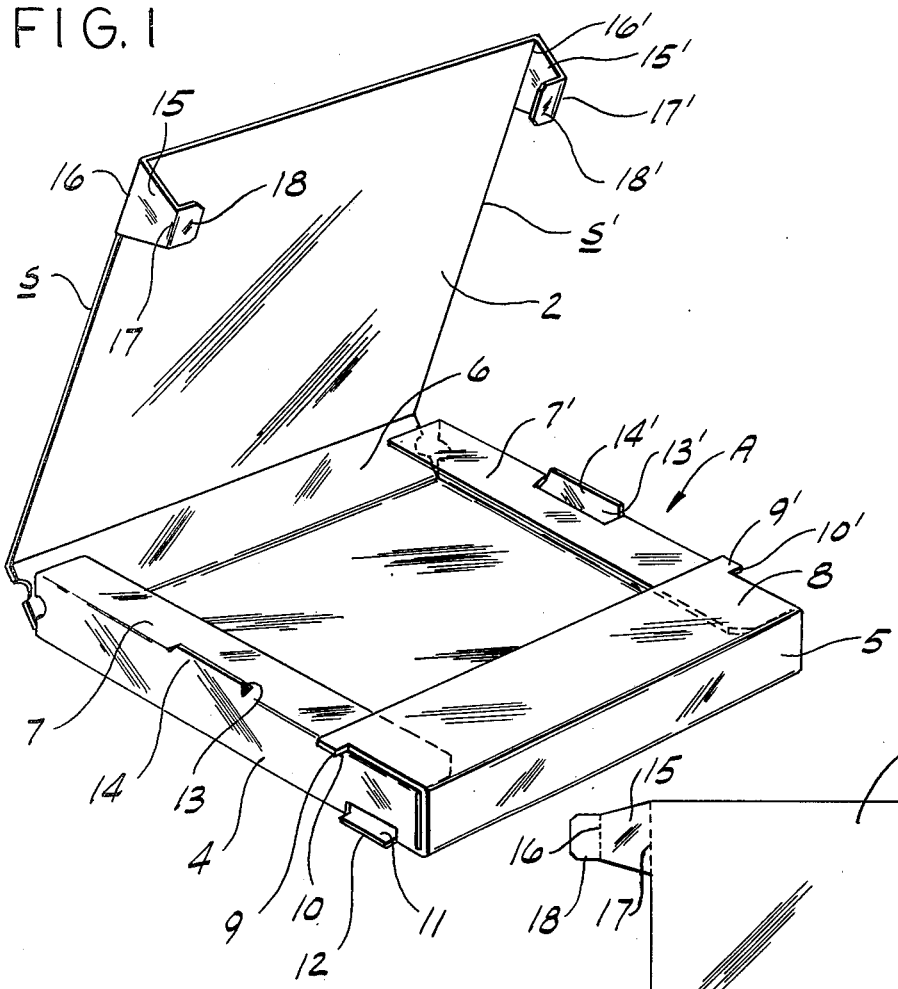
FIG. 1 is a perspective view of a box constructed in accordance with and embodying the present invention, illustrating same in open condition.

Referring now by reference characters to the drawings which illustrate the preferred embodiment of the present invention, A designates a box formed from a single blank 1 of cardboard, paperboard, fiberboard or other similar material which is adaptable for facile folding or bending into box A. Box A comprises a top wall or closure 2, a bottom wall 3, and preferably relatively shallow side walls 4,4' and front and back walls 5,6, respectively. At their upper edges each side wall 4,4' is continuous with a coextensive inturned flange 7,7', respectively, which latter are in planar parallel relationship to bottom wall 3; while front wall 5 is similarly continuous along the upper edge thereof with a rearwardly directed flange 8. Said flange 8 is supported by the underlying, forward portions of flanges 7,7', and in the rearward end portion thereof is provided with laterally outwardly extending stops 9,9' which project beyond the adjacent side walls 4,4' and present forwardly directed shoulders 10,10'. Each side wall 4,4' between the forward ends thereof and the proximate stop 9,9', is provided adjacent its bottom edge with an opening 11,11', respectively, as developed by a cut-away portion through the provision of complementarily dimensioned lateral projections 12, 12', respectively, from the proximate side of bottom wall 3.

Each flange 7,7' in its central portion is cut-away, as at 13,13', respectively, providing an abutment 14,14', respectively, extending upwardly from the related side wall 4,4', respectively, for purposes presently appearing.

Top wall 2 integrally contains a pair of locking tabs 15,15' which are formed at the forward ends of the lateral edges s,s', respectively, thereof, and are turned downwardly about a fold line 16,16', respectively, coincident with the edges s,s', into substantially planar perpendicular relationship with respect to top wall 2 and with the respective lower or distal end portions thereof being bent inwardly, as along fold lines 17, 17', respectively, toward each other to provide tongues 18,18', respectively, for reception within openings 11,11', respectively; with the same thus extending inwardly beyond the proximate side wall 4,4' for locking box A in closed condition. It will be observed that in such state tongues 18,18' will be fully supported on their under surface by bottom wall 3 and projections 12,12'.

Figure 5:
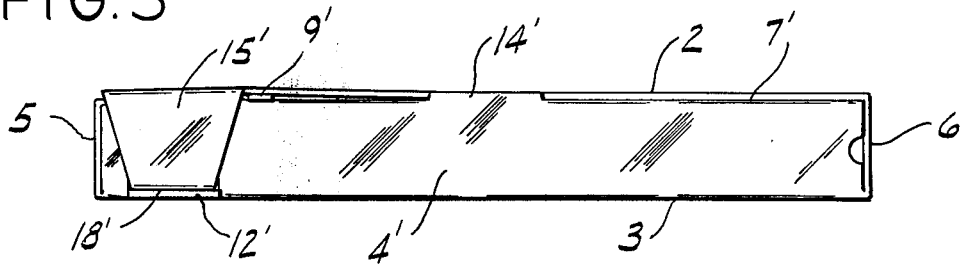
FIG. 5 is a side elevational view of the box in closed condition.

As is evident from the drawings, locking tabs 15,15', which may be of greater transverse extent than the associated tongues 18,18' for strength enhancement, are of such width as to be presented forwardly of the adjacent shoulder 10,10' of stops 9,9', respectively, when box A is closed (FIG. 5).

With box A in closed condition it will be observed that closure 2 will be supported upon flanges 7,7' and 8, and be thereby inhibited against an inadvertent accidental downward movement which might assert a crushing force upon the box contents, such as, for example, pizza, as well as other comestibles of broadly similar character, as pies, cakes, and the like. With locking tabs 15,15' in latched condition, shoulders 10,10' serve to prevent premature opening of closure 2 since the rearward edges of locking tabs 15,15' abut thereagainst and thus retain the interengagement between tongues 18,18' and the associated openings 11,11', respectively. Accordingly, the user to gain access to the box interior must necessarily withdraw tongues 18,18' as well as pull tabs 15,15' outwardly to clear stops 9,9' in order to bring about opening action. Furthermore, in addition to the restraint provided by the engagement of tongues 18,18' any tendency of closure 2 to swing into box-open condition is inhibited by the abutment between tabs 15,15' and shoulders 10,10' since the rearward component of such movement is blocked.

Abutments 14,14' are disposed outwardly of, but in immediate adjacency to, side margins s,s', respectively, of closure 2 when box A is in closed condition and thereby obstructs any lateral shifting of closure 2 that might tend to develop during transport of box A, providing further integrity to box A when closed with increased protection to the contents thereof.

Thus, box A incorporates unique structural features which cooperate to provide a sturdiness and stability reliably protective of the contents against undesired displacement or appeal-destroying damage. Furthermore, box A in addition to providing a novel arrangement of components for rendering the same secure in closed condition also embodies contentguarding components constituted of flanges 7,7' with overlapping flange 8 located between the box contents and top wall 2. It must be observed that stops 9,9' also serve to limit flange 8 against any inadvertent downward swinging.

Figure 2:
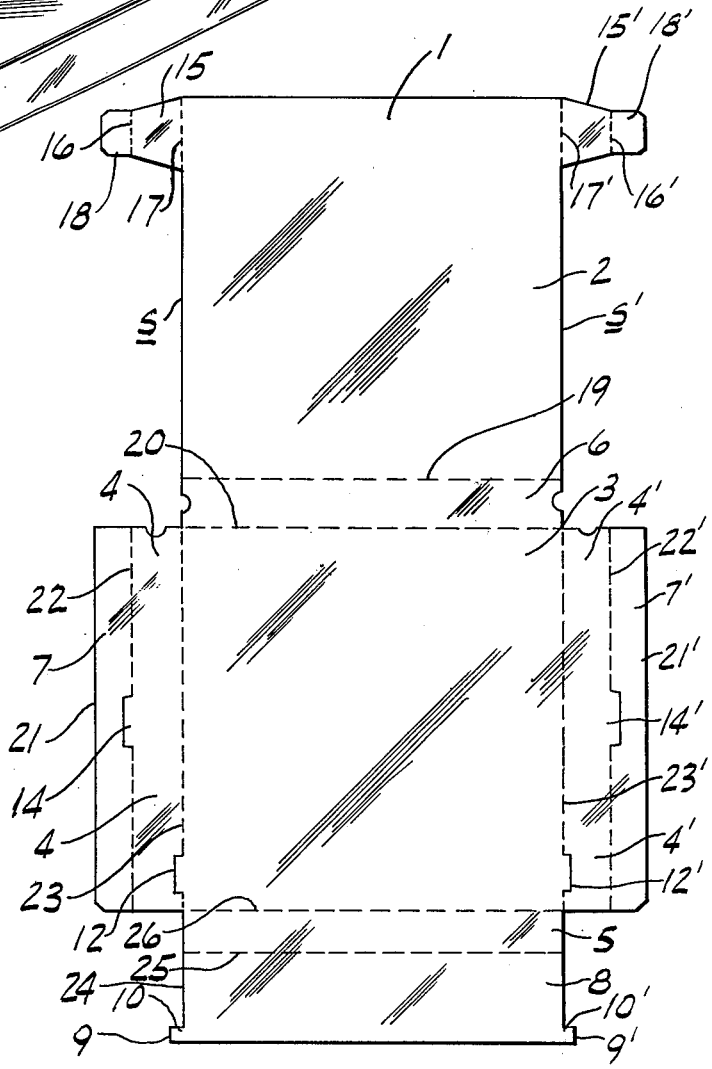
FIG. 2 is a plan view of a blank for forming the box of the present invention.
Figure 3:
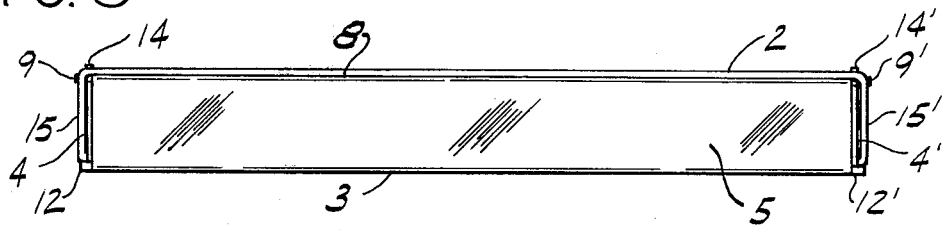
FIG. 3 is a front end view of the box in closed condition.
Figure 4:
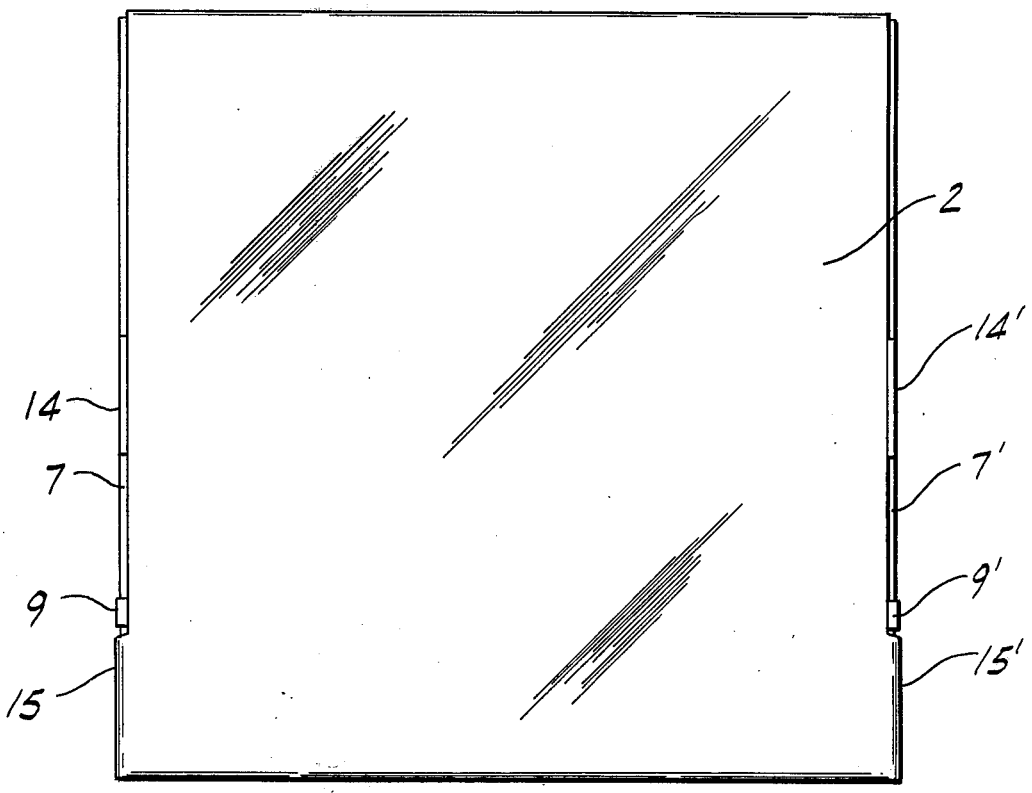
FIG. 4 is a top plan view of the box in closed condition.

As may best be seen in FIG. 2, box A is easily formed from a single die cut blank 1. It will be seen that the portion of blank 1 constituting top closure 2 is separated from the portion defining bottom wall 3 by a pair of transversely extending parallel fold lines 19,20 which define the normally upper and lower limits of back wall 6. Lateral sections 21,21' project from each side of the portion of blank 1 constituting bottom wall 3 and each of which, substantially centrally thereof, is provided with a coextensive line of bending 22,22' forming the demarcation between the associated flanges 7,7', respectively, and side walls 4,4', respectively; the inner or normally lower edges of said side walls 4,4' being defined by fold lines 23,23' parallel with lines of bending 22,22', respectively, and constituting as well the lower side edges of bottom wall 3 when box A is assembled. An extension 24 is provided at the end of blank 1 remote from the portion constituting top wall 2 and incorporates a pair of parallel bend lines 25,26 which extend transversely of such extension 24 and provide the normal upper and lower edges of front wall 5. The portion of extension 24 between bend line 25 and the outer edge of extension 24 composes flange 8.

It is believed that from the mere description of blank 1 the requisite steps for manipulating same as to develop box A is quite obvious.

By reason of its novel construction box A obviates resort to any independent expedients for securing same in closed condition such as string, tape, adhesives and the like.

Having described my invention what I claim and desire to obtain by Letters Patent is:

1. A box construction having a bottom wall, parallel side walls, front and back walls, a top wall closure swingable about its rearward end upon said rear wall for movement between raised, box-open and lowered, box-closed condition, latch tabs extending downwardly from said top wall when in closed condition, keeper-forming means provided in said side walls for accepting said latch tabs when the box is in closed condition, and stop means projecting laterally of said box immediately rearwardly of said latch tabs when the box is in closed condition for detent relationship with the rearward edges of said latch tabs to inhibit accidental opening of said box.

2. A box construction as defined in claim 1 wherein said latch tabs are provided at opposite sides of said top wall and said keeper-forming means constitute apertures provided in said side walls and opening laterally outwardly.

3. A box construction as defined in claim 2 and further characterized by said latch tabs being provided at the forward end portions of the sides of said top wall and said apertures being formed in the forward end portions of said side walls.

4. A box construction as defined in claim 1 and further characterized by a rearwardly extending flange integral with the front wall, said stop means being formed at opposite sides of said front flange.

5. A box construction as defined in claim 4 and further characterized by said stop means including a forwardly directed shoulder.

6. A box construction as defined in claim 4 and further characterized by a flange extending inwardly from the upper end of each side wall, said side wall flanges in their forward portions underlying said front wall flange.

7. A box construction as defined in claim 1 and further characterized by abutments formed with each side wall for projection above the upper side margin thereof, said abutments being disposed outwardly of the adjacent side margin of the top wall closure when the box is in closed condition for inhibiting inadvertent lateral shifting of said top wall closure.

8. A box formed from a single, die-cut blank of foldable material comprising a bottom wall, a rear wall, a top wall closure swingable along one end margin thereof continuous with the rear wall between raised or box-open condition and lowered, box-closed condition, said top wall closure being free along the side margins thereof and the other or front end margin, a pair of side walls each continuous on one side margin thereof with said bottom wall on opposite sides thereof, said side walls each having an inturned flange on the other or upper side margin of each side wall for overlying, vertically spaced relationship to said bottom wall, a front wall continuous on the lower side margin thereof with said bottom wall along the edge thereof opposite said rear wall, a rearwardly folded flange provided on the upper side margin of said front wall and disposed in unattached supported relation upon the adjacent underlying portions of said side wall flanges in their forward end portions, said top wall closure being of such extent as to overlie said side wall flanges and said front wall flange when the box is in closed condition, and detachable means engaging said top wall to each of said side walls beneath said front flange.

9. A box as defined in claim 8 wherein stop means project laterally from said front flange for disposition rearwardly of said detachable means when said box is in closed condition for detaining relationship therewith to prevent accidental opening of said box.

10. A box as defined in claim 9 wherein said detachable means comprise latch tabs provided on opposite side margins of said top wall closure and apertures provided on each side wall in the front end portion thereof beneath said front flange for lockingly accepting said latch tabs, and detent members provided on each side wall and projecting above the related side flange for abutting relationship with the adjacent side margin of said top wall closure to inhibit unauthorized lateral shifting thereof when said box is in closed condition.

* * * * *

REEXAMINATION CERTIFICATE (142nd)

United States Patent [19]

Orchard

[11] B1 4,265,393

[45] Certificate Issued Nov. 29, 1983

[54] BOX CONSTRUCTION

[75] Inventor: Edgar L. Orchard, St. Louis County, Mo.

[73] Assignee: Orco Sales Co. Inc., St. Louis, Mo.

Reexamination Request:
No. 90/000,204, May 24, 1982

Reexamination Certificate for:

| | |
|---|---|
| Patent No.: | **4,265,393** |
| Issued: | **May 5, 1981** |
| Appl. No.: | **83,237** |
| Filed: | **Oct. 10, 1979** |

[51] Int. Cl.[3] ..... B65D 5/10; B65D 5/66; B65D 45/00

[52] U.S. Cl. ..... 229/40; 229/36; 229/44 R; 229/45 R

[58] Field of Search ..... 229/33, 36, 40, 43, 229/44 R, 45 R

[56] References Cited

U.S. PATENT DOCUMENTS

| | | | |
|---|---|---|---|
| 1,182,585 | 5/1916 | Richardson | 229/36 X |
| 1,824,927 | 9/1931 | Powell | 229/33 X |
| 2,285,991 | 6/1942 | Lester | 229/40 X |
| 2,944,471 | 7/1960 | Lynch | 229/36 X |
| 3,114,492 | 12/1963 | Engström | 229/40 X |
| 3,357,544 | 12/1967 | Gingher | 229/40 X |
| 3,368,735 | 2/1968 | Levi | 229/40 |
| 3,627,541 | 12/1971 | Farquhar | 229/40 X |
| 4,046,311 | 9/1977 | Voytko | 229/40 |
| 4,236,740 | 12/1980 | Sorenson | 229/33 |

FOREIGN PATENT DOCUMENTS

| | | | |
|---|---|---|---|
| 373812 | 3/1907 | France | 229/36 |
| 215415 | 9/1967 | Sweden . | |
| 175832 | 6/1965 | Switzerland . | |

*Primary Examiner*—Herbert F. Ross

[57] ABSTRACT

A box of cardboard, paperboard, fiberboard or the like assembled from a single, die cut blank comprising a bottom wall, side walls, front and back walls, and a swingable top closure. The side walls are provided with inturned flanges underlying a flange extending rearwardly from the front wall which latter contains outwardly projecting stops. The top wall carries locking tabs for restrictive abutting relationship with the proximate stop and which tabs embody tongues lockingly engageable in openings in said side wall; there being abutments for limiting lateral shifting of said top wall when the box is closed.

REEXAMINATION CERTIFICATE ISSUED UNDER 35 U.S.C. 307.

BOX CONSTRUCTION

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 8 and 9, having been finally determined to be unpatentable, are cancelled.

Claims 1, 2, 4, 5, 7, and 10 are determined to be patentable as amended:

Claims 3 and 6, dependent on amended claims, are determined to be patentable.

New claims 11–14 are added and determined to be patentable.

1. A box construction having a bottom wall, parallel side walls, front and back walls, a top wall closure *having a front free end, opposite side edge portions, and being* swingable about its rearward end upon said rear wall for movement between raised, box-open and lowered, box-closed condition, latch tabs extending downwardly from said top wall when in closed condition, keeper-forming means provided in said side walls for accepting said latch tabs when the box is in closed condition, and stop means projecting laterally *outwardly beyond the adjacent side walls of the container, the adjacent side edge portion of the top wall, and the adjacent latch tab when the box is in closed condition, in which latter condition said stop means are* [of said box] immediately rearwardly of said latch tabs [when the box is in closed condition] for detent relationship with the rearward edges of said latch tabs to inhibit accidental opening of said box.

2. A box construction as defined in [claim] *claims 1 or 12* wherein said latch tabs are provided at opposite sides of said top wall and said keeper-forming means constitute apertures provided in said side walls and opening laterally outwardly.

4. A box construction as defined in [claim] *claims 1 or 12* and further characterized by a rearwardly extending flange integral with the front wall, said stop means being formed at opposite sides of said front flange.

5. A box construction as defined in [claim 4] *claims 1 or 12* and further characterized by said stop means including a forwardly directed shoulder [in confronting relationship to] *extending across the rearward edge of the proximate latch tab.*

7. A box construction as defined in [claim] *claims 1 or 12* and further characterized by abutments formed with each side wall for projection above the upper side margin thereof, said abutments being disposed outwardly of the adjacent side margin of the top wall closure when the box is in closed condition for inhibiting inadvertent lateral shifting of said top wall closure.

10. A box as defined in claim [9] *11* wherein said detachable means comprise latch tabs provided on opposite side margins of said top wall closure and apertures provided on each side wall in the front end portion thereof beneath said front flange for lockingly accepting said latch tabs, and detent members provided on each side wall and projecting above the related side flange for abutting relationship with the adjacent side margin of said top wall closure to inhibit unauthorized lateral shifting thereof when said box is in closed condition.

*11. A box formed from a singly, die-cut blank of foldable material comprising a bottom wall, a rear wall, a top wall closure swingable along one end margin thereof continuous with the rear wall between raised or box-open condition and lowered, box-closed condition, said top wall closure being free along the side margins thereof and the other or front end margin, a pair of side walls each continuous on one side margin thereof with said bottom wall on opposite sides thereof, said side walls each having an inturned flange on the other or upper side margin of each side wall for overlying, vertically spaced relationship to said bottom wall, a front wall continuous on the lower side margin thereof with said bottom wall along the edge thereof opposite said rear wall, a rearwardly folded flange provided on the upper side margin of said front wall and disposed in unattached supported relation upon the adjacent underlying portions of said side wall flanges in their forward end portions, said top wall closure being of such extent as to overlie said side wall flanges and said front wall flange when the box is in closed condition, detachable means engaging said top wall to each of said box side walls spacedly downwardly of and below said front flange, and stop means projecting laterally outwardly from portions of said front flange underlying said top wall, said stop means projecting laterally outwardly beyond said top wall for disposition rearwardly of said detachable means when said box is in closed condition for detaining relationship therewith to prevent accidental opening of said box.*

*12. A box construction having a bottom wall, parallel side walls, front and back walls, a top wall closure swingable about its rearward end upon said rear wall for movement between raised, box-open and lowered, box-closed condition, latch tabs extending downwardly from said top wall when in closed condition, keeper-forming means provided in said side walls for accepting said latch tabs when the box is in closed condition, and stop means projecting laterally outwardly beyond the adjacent side wall of said box immediately rearwardly of said latch tabs when the box is in closed condition for detent relationship with the rearward edges of said latch tabs to inhibit accidental opening of said box.*

*13. A box construction having a bottom wall, parallel side walls, front and back walls, a top wall closure swingable about its rearward end upon said rear wall for movement between raised, box-open and lowered, box-closed condition, latch tabs extending downwardly from said top wall when in closed condition, keeper-forming means provided in said side walls for accepting said latch tabs when the box is in closed condition, and an arm-like stop member projecting freely laterally outwardly of each side wall of said box immediately rearwardly of the adjacent latch tab when the box is in closed condition for non-interlocking movement-obstructing relationship with the rearward edge of the adjacent tab to inhibit accidental opening of said box.*

*14. A box construction as defined in claims 1 or 12 and further characterized by a rearwardly extending flange integral with the upper portion of the front wall, a flange extending inwardly from the upper end of each side wall, said front wall flange overlyingly resting upon the forward portions of said side wall flanges when the box is in closed condition, said front wall flange having a rearward free edge presented spacedly rearwardly of said downwardly extending latch tabs when the box is in closed condition,*

*and said stop means comprises an arm-like member extending freely laterally outwardly from each side of said front wall flange in its portion rearwardly of the latch tabs beyond the adjacent box side wall and having a forward edge in confronting relationship to the rearward edge of the adjacent latch tab for detaining, non-interlocking movement-obstructive relationship with the adjacent latch tab.*

* * * * *